US009205462B2

(12) United States Patent
Zimmermann

(10) Patent No.: US 9,205,462 B2
(45) Date of Patent: Dec. 8, 2015

(54) METHOD AND APPARATUS FOR SORTING FLAT MAIL ITEMS INTO DELIVERY POINT SEQUENCING

(75) Inventor: Armin Zimmermann, Constance (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 769 days.

(21) Appl. No.: 12/350,356

(22) Filed: Jan. 8, 2009

(65) Prior Publication Data

US 2009/0173669 A1 Jul. 9, 2009

(30) Foreign Application Priority Data

Jan. 8, 2008 (DE) ..... 10 2008 003 539

(51) Int. Cl.
*B07C 5/02* (2006.01)
*B07C 3/02* (2006.01)

(52) U.S. Cl.
CPC ..... *B07C 3/02* (2013.01)

(58) Field of Classification Search
USPC ..... 209/3.1, 552, 584, 630
See application file for complete search history.

(56) References Cited

U.S. PATENT DOCUMENTS

| | | | | |
|---|---|---|---|---|
| 4,388,994 | A * | 6/1983 | Suda et al. | 209/564 |
| 5,421,464 | A | 6/1995 | Gillmann et al. | |
| 5,733,592 | A * | 3/1998 | Wettstein et al. | 426/416 |
| 5,924,576 | A * | 7/1999 | Steenge | 209/584 |
| 6,107,587 | A * | 8/2000 | Itoh et al. | 209/583 |
| 6,703,574 | B1 | 3/2004 | Kechel et al. | |
| 2006/0122725 | A1 * | 6/2006 | Duffy et al. | 700/157 |
| 2009/0152177 | A1 * | 6/2009 | Greenspan et al. | 209/580 |

FOREIGN PATENT DOCUMENTS

| | | |
|---|---|---|
| DE | 69713482 T2 | 2/2003 |
| EP | 0 634 957 B1 | 1/1995 |
| EP | 0812629 A1 | 12/1997 |
| EP | 0862953 B1 | 6/2002 |

* cited by examiner

*Primary Examiner* — Terrell Matthews
(74) *Attorney, Agent, or Firm* — Laurence Greenberg; Werner Stemer; Ralph Locher

(57) ABSTRACT

A method and an apparatus for sorting flat mail items into delivery point sequencing include sorting the mail items into sequence and deposited them in a sorting facility with a number of F compartments. In order to achieve sorting into delivery point sequencing to a plurality of mail addresses with a comparatively small number of compartments, the mail items are presorted into a number of M storage modules, which differ from the compartments in that they have an internal withdrawal apparatus, in a presorting facility.

15 Claims, 6 Drawing Sheets

METHOD AND APPARATUS FOR SORTING FLAT MAIL ITEMS INTO DELIVERY POINT SEQUENCING

CROSS-REFERENCE TO RELATED APPLICATION

This application claims the priority, under 35 U.S.C. §119, of German Patent Application DE 10 2008 003539.4, filed Jan. 8, 2008; the prior application is herewith incorporated by reference in its entirety.

BACKGROUND OF THE INVENTION

Field of the Invention

The invention relates to a method for sorting flat mail items into delivery point sequencing, in which the mail items are sorted into sequence and deposited in a sorting facility with a number of F compartments. The invention also relates to an apparatus for sorting flat mail items into delivery point sequencing with a sorting facility having a number of F compartments for depositing mail items that have been sorted into sequence and a processing device for controlling the sorting into delivery point sequencing.

Flat mail items, such as letters, large-format letters, postcards, shrink-wrapped newspapers and so on, are sorted in very large numbers by address in mail centers or large post offices and are optionally deposited in a plurality of stacking compartments after a presorting operation. The degree of sorting that can be achieved is determined by the number of sorting passes and the number of stacking compartments, to which the mail items are distributed, in each sorting pass. A high throughput of flat mail items through the sorting units is desirable in order to be able to sort a large number of mail items in a short time.

When mail items are sorted into delivery point sequencing, a large number of mail items is ordered from a random sequence into a predetermined sequence. The predetermined sequence can be a function of the mailing addresses of the mail items, e.g. their delivery addresses. Such a sorting into delivery point sequencing is known from European Patent EP 0 634 957 B1, corresponding to U.S. Pat. No. 5,421,464.

Sorting into delivery point sequencing generally requires a number of sorting passes, at the end of which large quantities of mail items have to be removed manually in stacks in a predetermined sequence from the compartments and put back onto a bed of a separating apparatus. In a following sorting pass those already presorted mail items are sorted more specifically into the compartments. Since removing mail items from the compartments is time-consuming and susceptible to error, sorting into delivery point sequencing with few sorting passes is advantageous. Therefore, a large number of compartments is required to carry out sorting into delivery point sequencing where there are a large number of mailing addresses.

SUMMARY OF THE INVENTION

It is accordingly an object of the invention to provide a method and an apparatus for sorting flat mail items into delivery point sequencing, which overcomes the hereinafore-mentioned disadvantages of the heretofore-known methods and devices of this general type and with which it is possible to achieve sorting into delivery point sequencing where there are a large number of mailing addresses with comparatively low susceptibility to error.

With the foregoing and other objects in view there is provided, in accordance with the invention, a method for sorting flat mail items into delivery point sequencing. The method comprises presorting the mail items into a number of M storage modules in a presorting facility, sorting the mail items into sequence and depositing the mail items in a sorting facility with a number of F compartments, and configuring the storage modules differently than the compartments by providing the storage modules with an internal withdrawal apparatus.

The upstream configuration of the presorting facility means that the number of sorting passes, and therefore the susceptibility to error, can be reduced or mail items can be sorted to a greater number of mailing addresses with the same number of sorting passes.

Presorting expediently takes place in such a manner that sorting into sequence is established in the compartments by sequential emptying of the storage modules into the sorting facility, in conjunction with subsequent sorting of the mail items from the storage modules into the compartments of the sorting apparatus. During sequential emptying of the storage modules into the sorting facility, a first storage module is emptied and a continuous flow of mail items is formed from the storage module into the sorting facility, after which a second and then a third storage module and optionally further storage modules are emptied. Sorting the mail items into the compartments, in other words arranging the mail items one behind the other in the compartments after the last sorting pass, allows the mail items to be sorted in the delivery point sequencing of one or more delivery operators.

Sorting into sequence, in other words placing the mail item in a desired sequence, can be achieved with one sorting pass, in which sorting can take place to F×M mailing addresses. Generally, the mail items are moved into the desired sequence with two or three sorting passes, with the mail items then only being placed in the desired sequence in the last sorting pass by the sequential emptying of the storage modules.

The mail items can be mail of all types, having a length and a width which are respectively significantly greater than their thickness, e.g. by a factor of 10 at least. The storage modules are constructed for the parallel accommodation in each instance of a multiplicity of mail items, expediently at least ten, in particular at least 50, which can be stored in the storage module, in particular stacked one on top of the other. In contrast to the compartments they each have an internal withdrawal apparatus for separating the mail items deposited in a storage module into a flow of mail items, in particular with identical gaps between the mail items. The presorting facility is upstream of the sorting facility in the transportation direction of the mail items. The mail items therefore pass through the presorting facility first and then the sorting facility.

In accordance with another advantageous mode of the invention, a bottom mail item for at least some of the F compartments is stacked in the storage module to be emptied first in the sequence, at least one mail item above this for at least some of the F compartments is stacked in the next storage module to be emptied and at least one higher mail item respectively for at least some of the F compartments is stacked in the storage modules to be emptied later. This allows the desired sequence for sorting into delivery point sequencing to be achieved in a simple manner.

In accordance with a further mode of the invention, the sorting facility can be kept simple, if sorting into sequence takes place in at least two sorting passes and the mail items are removed from the compartments after the first sorting pass and fed as a stack to at least one separating device to be fed to the storage modules. Feeding can take place manually.

In order to be able to sort to a large number of mailing addresses, for example to 10,000 mailing addresses, which can be assigned respectively to a possible delivery address or mailbox, the sorting facility includes a large number of compartments, e.g. 72 compartments, which for economic reasons are of simple construction. In contrast, the storage modules are significantly more complex, to be able to separate the mail items deposited in them again in an automated manner.

In accordance with an added mode of the invention, a good ratio of sorting output to sorting costs can be achieved, if the number F of compartments of the sorting facility is greater by at least a factor of 2 than the number M of storage modules.

In accordance with an additional mode of the invention, the speed of the sorting process can be increased, if the mail items are carried by way of $M_1 \geq 1$ parallel mail item feeds to the storage modules and from there into $M_2 \geq 2$ parallel mail item collectors for one respective segment of the sorting facility. Expediently, each module is assigned to only one segment and only transports mail items thereto.

In accordance with yet another mode of the invention, fast presorting can be achieved, if the storage modules are combined into $M_3 \geq 2$ parallel groups and mail items from one flow of mail items are inserted into storage modules of at least one group and at the same time mail items are collected from storage modules of at least one group.

In accordance with yet a further advantageous mode of the invention, sorting into delivery point sequencing takes place in at least two sorting passes, with sorting being carried out in a first sorting mode in the first sorting pass and in a second sorting mode in the second sorting pass, and the second sorting mode being different from the first sorting mode with respect to sorting in the presorting facility. A high-speed presorting operation can be combined with a refined post-sorting operation. The sorting facility and the presorting facility are expediently used respectively in the two sorting passes. In the second sorting pass the mail items are then advantageously deposited in the storage modules in such a manner that sorting into delivery point sequencing is established by their sequential emptying, in conjunction with the subsequent sorting of the mail items by the sorting facility.

In accordance with yet an added mode of the invention, a high presorting speed with a sorting resolution of $M_2$ can be achieved, if the mail items from the presorting facility are presorted in the first sorting pass to $M_2 \geq 2$ parallel mail item collectors, for one respective segment, in particular for just one segment, of the sorting facility.

In accordance with yet an additional mode of the invention, a high sorting output can be achieved with respect to the degree of sorting and/or sorting speed through the use of a bypass of the presorting facility, which circumvents the storage modules and is used for presorting.

In accordance with again another mode of the invention, mail items, which are deposited in a compartment in one sorting pass, form a compartment content. In order to achieve a high level of sorting efficiency, it is advantageous if a number of compartments contents are stored in the following sorting pass in the same m storage modules, where $m<M$. Where $m=4$, the sorting method is particularly efficient with respect to economy and sorting quality.

In accordance with again a further mode of the invention, if the sorting facility has at least two segments, each with a plurality of compartments, all the compartment contents of at least one segment are expediently stored in the same $m<M$ storage modules with equal advantage in the following sorting pass.

In particular, when a sorting facility with a number of segments is used, it is advantage if a number of the M storage modules are assigned to one segment and another number of the M storage modules are assigned to another segment. The presorting facility can achieve a high level of economy if, besides the storage modules, it has a bypass, which circumvents the storage modules and is also used for sorting.

In accordance with again an added mode of the invention, in this process, as many items as are in two storage modules are expediently inserted into the bypass. Therefore, the bypass can be assigned twice the number of addresses that can be assigned to a storage module.

In accordance with again an additional advantageous mode of the invention, mail items are fed to a separating device and from there in sections to the storage modules, with the storage modules being emptied into the sorting apparatus after each section. It is possible to generate a regular flow of mail items to the sorting facility.

In accordance with still another mode of the invention, efficient sorting is achieved, if a section is formed of $f>1$ compartments contents, with mail items deposited in a compartment in one sorting pass forming a compartment content. Depending on the size of the storage modules, it is possible to store a number of compartment contents in the storage modules, before these are emptied again. A section in this case expediently is formed of $f=n\ M_1$ compartment contents, where n is a whole number and the mail items are transported to the storage modules by way of $M_1 \geq 1$ parallel mail item feeds.

With the objects of the invention in view, there is concomitantly provided an apparatus for sorting flat mail items into delivery point sequencing. The apparatus comprises a sorting facility with a number of F compartments for depositing mail items sorted into sequence, a processing device for controlling sorting into delivery point sequencing, and a presorting facility disposed upstream of the sorting facility in a transportation direction of the mail items. The presorting facility has a number of M storage modules disposed in parallel and the storage modules differ from the compartments in that the storage modules have an internal withdrawal apparatus for respective parallel accommodation of a multiplicity of mail items. It is possible to achieve a high level of sorting refinement with a small number of sorting passes.

Other features which are considered as characteristic for the invention are set forth in the appended claims.

Although the invention is illustrated and described herein as embodied in a method and an apparatus for sorting flat mail items into delivery point sequencing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE SEVERAL VIEWS OF THE DRAWING

DETAILED DESCRIPTION OF THE INVENTION

Figure 2:
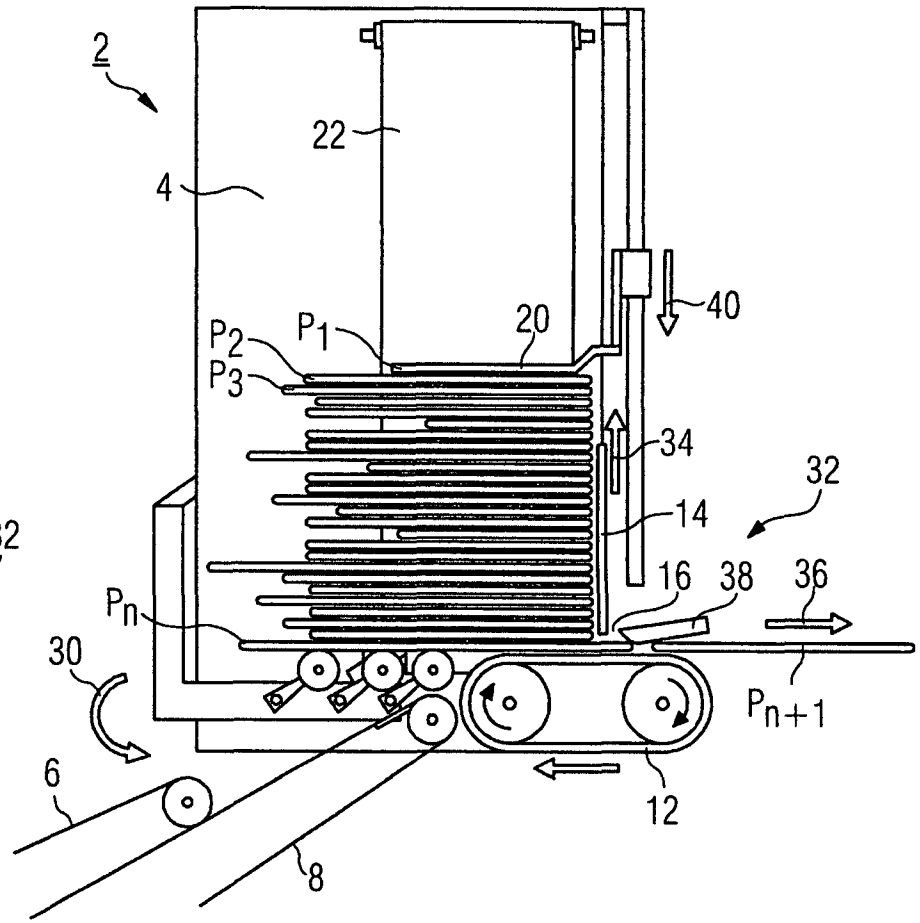
FIG. 2 is a top-plan view of the storage module of FIG. 1 in a withdrawal mode.
Figure 1:
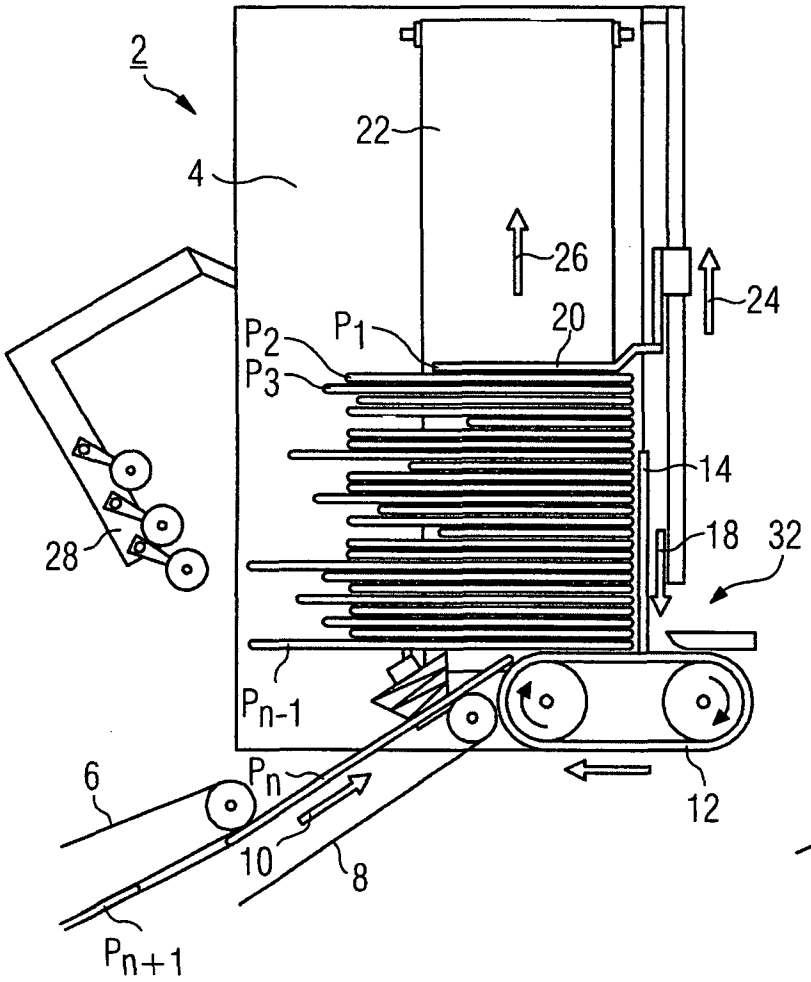
FIG. 1 is a diagrammatic, top-plan view of a storage module in an insertion mode.

Referring now to the figures of the drawings in detail and first, particularly, to FIGS. 1 and 2 thereof, there are seen diagrammatic illustrations of a storage module 2, in an insertion mode in FIG. 1 and in a withdrawal mode in FIG. 2. The storage module 2 is configured as a last-in-first-out module, with which the last inserted mail item is removed first. It includes a storage region 4, in which mail items $P_1, P_2, P_3, \ldots P_{n-1}$ are stored. In the diagram shown, the mail item $P_n$ will be the next mail item transferred into the storage region 4. It is fed between two feed belts 6, 8 to the storage module 2 in a transportation direction 10 and then taken up by a moving belt 12. The moving belt 12 is driven in a controlled manner in this case and conveys the mail items $P_1, P_2, \ldots P_{n-1}$ to a feed stop 14, with the result that the mail items $P_1, P_2, P_3, \ldots P_{n-1}$ are then located in the storage region 4 in a precisely defined position with respect to their front and bottom edges. In the position shown in FIG. 1, the feed stop 14 also blocks a withdrawal opening 16 which, as shown by an arrow 18, is positioned immediately in front of the moving belt 12 or advantageously interleaves with the moving belt 12.

It is expedient for the mail items $P_1, P_2, P_3, \ldots P_n$ to be brought into contact with the moving belt 12 with a certain feed pressure. In order to set this feed pressure a parting blade 20 and a subsurface conveyor belt 22 are provided, which can be moved in a manner that can be regulated very precisely in the stacking direction, in other words the direction in which the stack grows in the storage region 4, according to arrows 24, 26, when the storage module 2 is in the insertion mode. The parting blade 20 is used to generate the feed pressure on the moving belt 12 antiparallel to the stacking direction.

The storage module 2 also has a support roller configuration 28, which is swung back into an inactive state in the insertion mode shown in FIG. 1. It can be swung into its active state in a swing direction 30 (FIG. 2) and is part of a withdrawal facility 32, which also includes the moving belt 12 and serves to withdraw the mail items $P_1$-$P_n$ from the storage modules 2.

FIG. 2 shows the storage module 2 in its withdrawal mode. The support roller configuration 28 is in the engaged, active state and ensures that the next mail item $P_n$ to be withdrawn is oriented in a plane, which corresponds substantially to the plane spanned by the moving belt 12 and in proximity to the storage module 2 to the further conveyance direction. In the withdrawal mode according to an arrow 34, the feed stop 14 is moving upward, thus releasing the withdrawal opening 16. The snapshot shown in FIG. 2 shows the mail item $P_{n+1}$, which has already been fully withdrawn and is conveyed further in a withdrawal direction 36, and the mail item $P_n$, having a front edge which is just passing through the withdrawal opening 16 and is kept in contact with the moving belt 12 by a pusher 38. The pusher 38 in this case helps to prevent double withdrawals, since its friction coefficient is tailored to the friction torque acting on the moving belt 12 and holds back the mail item that is not in direct contact with the moving belt 12 when there is a double withdrawal. The parting blade 20 sets a withdrawal pressure, indicated by an arrow 40.

In order to be able to ensure that the at least largely vertical orientation of the mail items stored in the storage region 4 is reliably maintained even as the storage module 2 continues to be emptied, the subsurface conveyor belt 22 is driven as shown by an arrow, thereby displacing the mail items stored in the storage region 4 in conjunction with the pretensioned parting blade 20.

Figure 3:
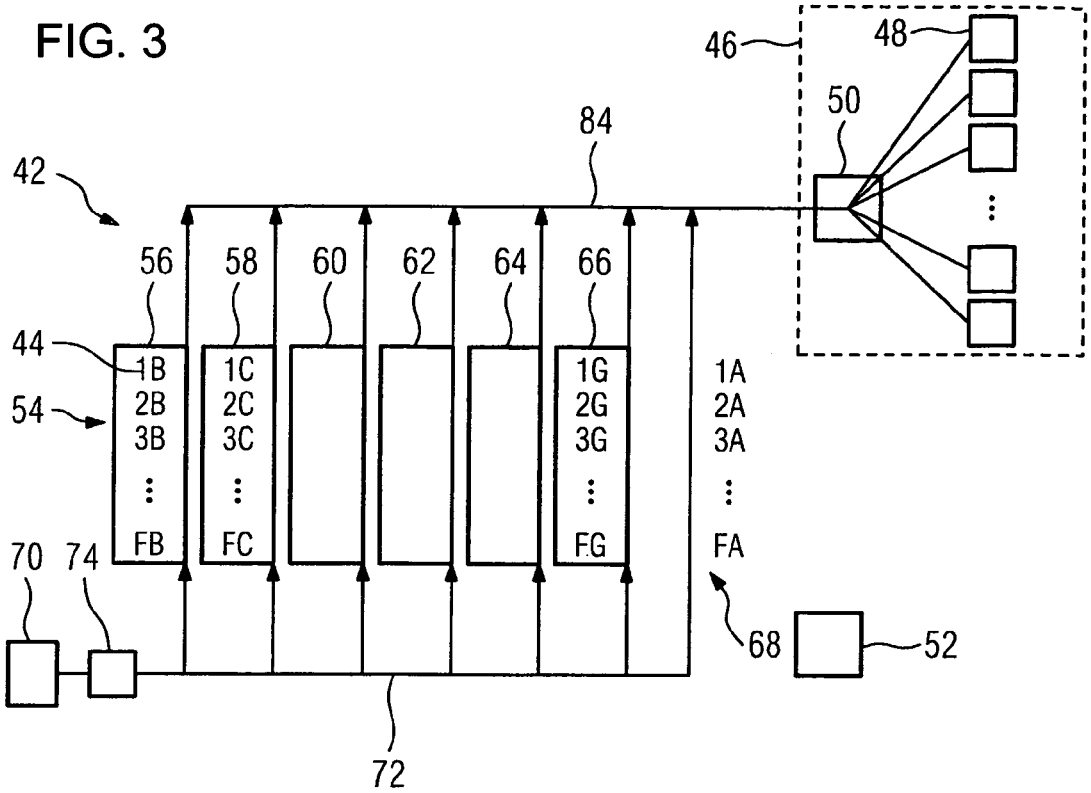
FIG. 3 is a top-plan view of an apparatus for sorting flat mail items with a presorting facility and a downstream sorting facility.

FIG. 3 shows an apparatus 42 for sorting flat mail items 44 into delivery point sequencing, in which the flat mail items 44 are shown in FIG. 3 with reference symbols 1A to FG. The apparatus 42 includes a sorting facility 46 with a number of F compartments 48, of which five compartments 48 are shown in FIG. 3. The number F is arbitrary and can vary between 2 and 300 or even be above that. A guide system 50, shown in a highly simplified manner in FIG. 3, distributes the mail items 44 to the compartments 48 according to their mailing addresses. Distribution is controlled by a control device 52, which is embodied as an electronic data processing facility.

Upstream of the sorting facility 46 is a presorting facility 54 with six storage modules 56-66 and a bypass 68, on which the mail items 44 can be transported from a separating device 70 to the sorting facility 46 circumventing the storage modules 56-66. The storage modules 56-66 are embodied as described with reference to FIGS. 1 and 2.

In order to carry out a sorting operation into delivery point sequencing, the mail items 44 are conveyed from the separating device 70 to the compartments 48 controlled by the control device 52 according to the method described below. Sorting into delivery point sequencing is carried out in a single sorting pass. The mail items 44 are presorted to the extent that their mailing addresses are only present in an address space with F×7 predetermined mailing addresses. A number of mail items 44 can have the same mailing address in this process.

The presorted, stacked mail items 44 are separated by the separating device 70, transferred to a mail item feed 72 in the form of a flow of mail items and conveyed past an address read device 74. This reads the delivery address and optionally the name and/or mailbox of the mail items 44 conveyed past and the control device 52 assigns a mailing address to each delivery address and/or mailbox. The mail items 44 are then distributed to the storage modules 56-66, with all the mail items with mailing addresses xB being stored in the first storage module 56, where $1 \leq x \leq F$. Similarly, the mail items 44 with mailing addresses xC are stored in the second storage module 58, etc. and the mail items 44 with mailing addresses xG are stored in the sixth storage module 66.

FIG. 3 shows the mail items 44, for example in the first storage module 56, as if they had already been sorted there according to mailing addresses 1B, 2B, 3B, . . . , FB. This strict sequence is shown in FIG. 3 simply for the sake of clarity. In reality the mail items 44 with mailing addresses 1B, 2B, 3B, . . . , FB would be mixed up randomly in the storage module 56.

Mail items 44 with mailing addresses xA are conveyed by the bypass 68 directly to the sorting facility 46 and sorted there into the compartments 48. In this process mail items 44 with mailing address 1A are deposited in the first compartment 48, those with mailing address 2A are deposited in the second compartment, etc., with a mailing address xA being assigned uniquely to each compartment.

When all the mail items 44 contained in the separating device 70 have been separated and all the mail items 44 with mailing address xA have been fed to the sorting facility 46, the storage modules 56-66 are emptied sequentially, in other words one after the other in a predetermined sequence. The storage module 56 is emptied first, so that the mail items 44 with mailing addresses xB are conveyed to the sorting facility 46 and sorted into the compartments 48 there, as described. The storage modules 58-66 are then emptied one after the other into the sorting facility 46, so that the mail items 44 are now present in the compartments 48 in the sequence xA, xB, xC, . . . , xF, with x being the respective compartment number. This establishes the desired sequence of mail items 44 in the compartments 48 for sorting into delivery point sequencing.

The mail items 44 can now be removed, compartment 48 by compartment 48, in compartment sequence 1 to F and combined to form a general stack or a number of sub-stacks and are present in the delivery point sequence of a delivery operator, for example.

Figure 4:
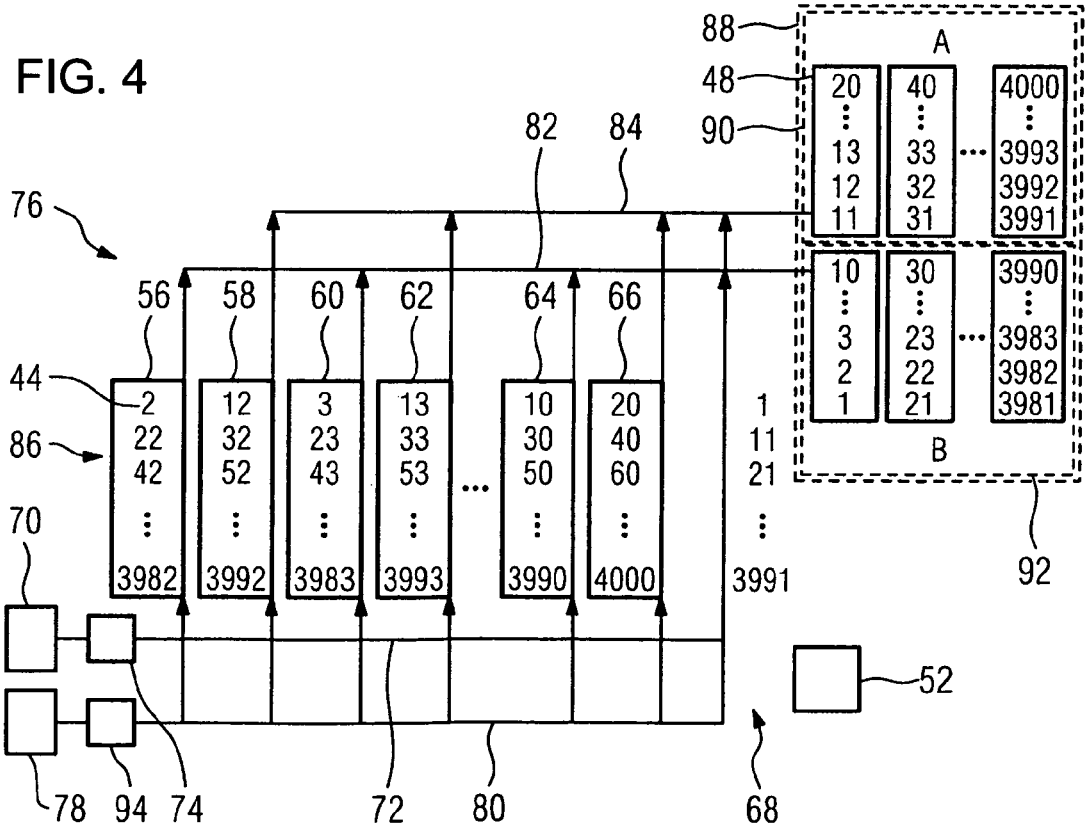
FIG. 4 is a top-plan view of another apparatus for sorting flat mail items with two mail item feeds and a sorting facility with two segments.

FIG. 4 shows a further diagrammatic illustration of another apparatus 76 for sorting flat mail items 44 into delivery point sequencing with two separating devices 70, 78, two mail item feeds 72, 80 and two mail item collectors 82, 84 from a presorting facility 86 to a sorting facility 88. The description of this and further figures which follows is substantially limited to the differences with respect to the exemplary embodiment in the previous figure, to which reference is made with respect to features and functions that remain the same. Elements that remain substantially the same in principle are assigned the same reference characters.

The presorting facility 86 includes 18 storage modules 56-66, of which only six are shown for the sake of clarity. The sorting facility 88 has 200 compartments 48, which are divided into two segments 90, 92, of 100 each.

Sorting into delivery point sequencing in one sorting pass is described below with reference to the apparatus 76 shown in FIG. 4, but it is also possible to sort into delivery point sequencing in a number of sorting passes on the apparatus 76. The separating devices 70, 78 are used to separate presorted mail items 44 with mailing addresses in an address space of 4000 mailing addresses in a parallel manner, convey them past address read devices 74, 94 and sort them by way of the mail item feeds 72, 80 into the storage modules 56-66 or feed them by way of the bypass 68 directly to the sorting facility 88. All the mail items 44 with mailing addresses xy2, where $0 \leq x \leq 39$ and y=0, 2, 4, 6 or 8, are now stored in the first storage module 56. The bypass 68 feeds through all the mail items 44 with mailing addresses xu1, where $0 \leq x \leq 39$ and $0 \leq u \leq 9$.

When all the mail items have been stored in the storage modules 56-66 or have passed through the bypass 68, the storage modules 56-66 are emptied sequentially one after the other, in this instance in pairs. The storage module 56 is emptied by way of the mail item collector 82 only into the segment 92 of the sorting unit 88 and at the same time the storage module 58 is emptied by way of the mail item collector 84 only into the segment 90. The storage modules 60, 62 are then emptied in pairs, until the last storage modules 64, 66 are emptied at the same time. Sorting into delivery point sequencing is completed and the mail items 44 can be removed sorted from the compartments 48 and combined into one or more stacks, depending on the size of the transportation container. The parallel feeding and collection of the mail items 44 with respect to the storage modules 56-66 means that sorting into delivery point sequencing can be carried out at high speed.

Figure 5:
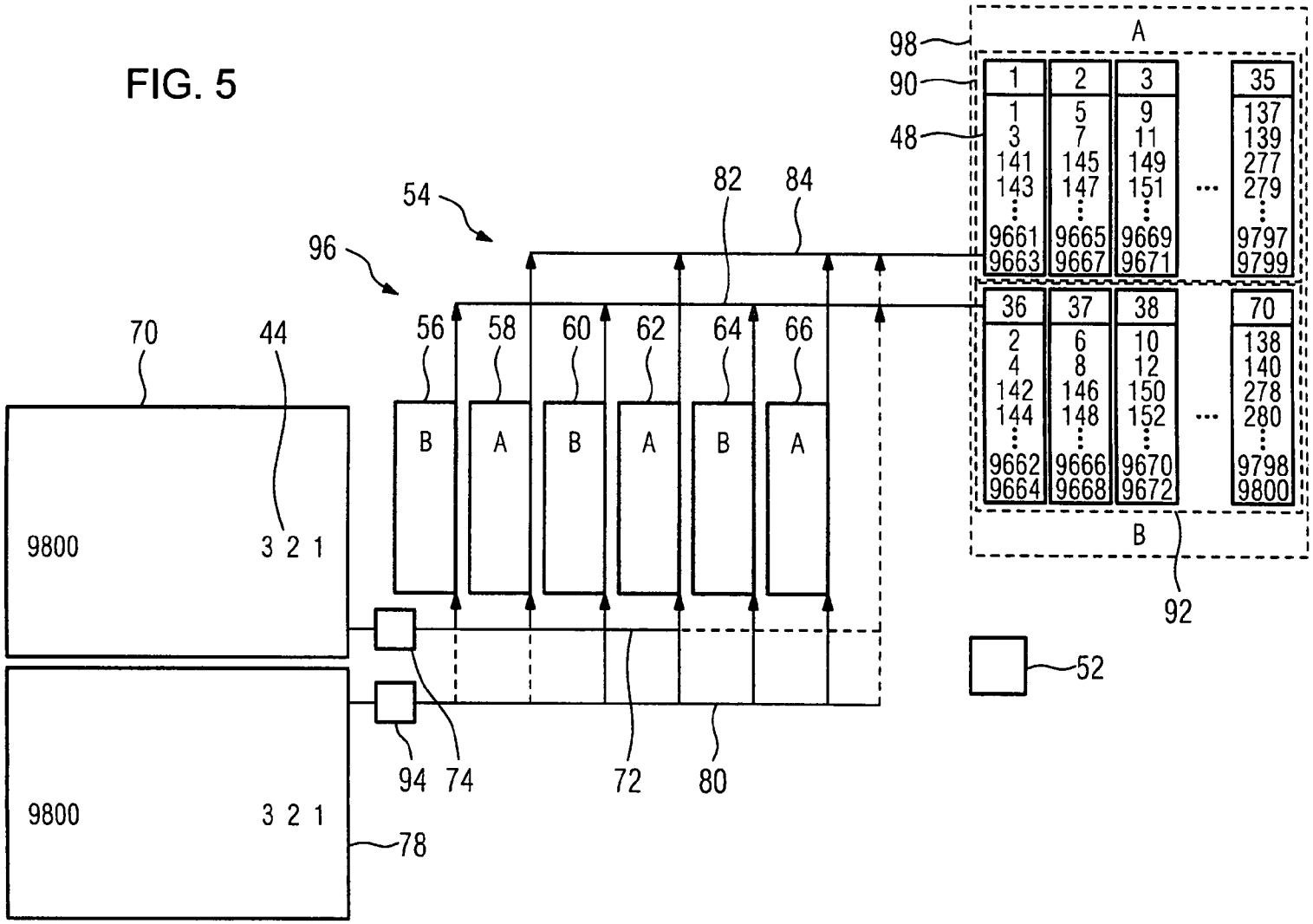
FIG. 5 is a top-plan view of a further apparatus for sorting flat mail items during a first sorting pass of an operation to sort into delivery point sequencing.

A further apparatus 96 for sorting flat mail items 44 into delivery point sequencing is shown in FIG. 5. It is similar in structure to the apparatus 76 and includes six storage modules 56-66 and a sorting facility 98 with 70 compartments 48, divided into two segments 90, 92. In order to implement a method for sorting into delivery point sequencing with two sorting passes, mail items are only sorted to the two segments 90, 92 in the first sorting pass in the presorting facility 54. For this purpose, presorted mail items 44 with mailing addresses in an address space of 9800 mailing addresses are separated in a parallel manner by the two separating devices 70, 78 from one respective stack and inserted as flows of mail items with a plurality of mail items 44 disposed at regular intervals one behind the other into the mail item feeds 72, 80. The bypass 68 and transport paths shown with a broken line are not used in the first sorting pass.

During a first time interval, mail items 44 from the first mail item feed 72, to which the first segment 90 was assigned by the control unit 52 as the transportation destination, are conveyed to the storage module 58 and deposited there. Mail items 44 from the first mail item feed 72, to which the second segment 92 was assigned, are conveyed to the storage module 56 and deposited there. Mail items 44 from the second mail item feed 80, to which the first segment 90 was assigned, are conveyed to the storage module 66 and deposited there. Finally, mail items 44 from the second mail item feed 80, to which the second segment 92 was assigned, are conveyed to the storage module 64 and deposited there.

During the first time period, the storage modules 56, 58, 64, 66 thus fill up with mail items 44 based on their statistical distribution according to transportation destination and thickness. The fill level of the storage modules 56, 58, 64, 66 can be monitored in this process by the control unit 52 with the aid of sensors.

At a time when the storage modules 56, 58 have reached a predetermined fill level, e.g. are half full, the first time period ends and a second time period begins. In this second time period the mail items 44 from the first mail item feed 72 are no longer fed to the storage modules 56, 58, but to the storage modules 60, 62, being distributed to the storage modules 60, 62 according to their transportation destinations. The storage modules 56, 58 are emptied at the same time, in that the mail items 44 deposited in them are separated, as described in relation to FIG. 2, and fed to the mail item collectors 82 and/or 84 for further transportation to the segment 92 and/or 90.

At a further time, one of the storage modules 64, 66 will be filled, with the other of the storage modules 64, 66 likewise being largely filled. The similarity of the fill levels of the two storage modules 64, 66 is a function of the distribution of the mail items 44 according to their transportation destinations and the capacity of the storage modules 64, 66. The greater their capacity, the more similar their relative fill levels according to the laws of statistics. It is therefore advantageous for the storage modules 56-66 to hold as many mail items 44 as possible, e.g. a stack height of at least 500 mm.

At this further time, a third operating mode starts, in which the mail items 44 in the mail item feeds 72, 80 are stored in the storage modules 56, 58 and 60, 62 and, at the same time, the mail items 44 from the storage modules 64, 66 are removed into the mail item collectors 82, 84.

The storage modules 64, 66 are emptied in roughly half the time it takes to fill the other storage modules 56-62, so that the storage modules 64, 66 are emptied when the storage modules 56, 58 are roughly half filled and the storage modules 60, 62 are roughly filled. At this time, when the storage modules 64, 66 are emptied, the control unit switches to the next operating mode, in which the mail items 44 are stored in the storage modules 56, 58 and 64, 66 and the initially still full storage modules 60, 62 are emptied.

If the storage modules 60, 62 are emptied at a next time, the control unit 52 switches to the next operating mode again, in which mail items are stored in the storage modules 60-66 and removed from the then full storage modules 56, 58.

The method continues to switch in this manner between three different operating modes, in which in each instance two of three groups of two storage modules 56-66 are filled and one group of two storage modules 56-66 is emptied. The switching times are made a function of the fill levels of the storage modules 56-66, in particular of the time of the complete emptying of those storage modules 56-66, which are just being emptied. Alternatively, additionally and in particular in a higher command hierarchy, the switching time can be determined by a fill level of those storage modules 56-66, in which mail items are just being stored. If one of them is completely full for example, switching of the operating modes is initiated, even if one or both of the storage modules 56-66 to be emptied has not yet been completely emptied.

Such presorting creates, largely independently of the distribution of the mail items 44 in the mail item feeds 72, 80 according to transportation destination, a regular flow of mail items into the two segments 90, 92, with the result that a high throughput is achieved.

Refined sorting does not take place until the sorting facility 98. All the mail items 44 with mailing addresses 2 nF+(4f−3) and 2 nF+(4f−1), where n is a whole number between 0 and 69, f is the number of compartments and F=70, are inserted into the compartments 48 of the first segment 90. All the mail items 44 with mailing addresses 2 nF+(4(f−35)−2) and 2 nF+(4(f−35)) are inserted into the compartments 48 of the second segment 90. Shown as a table:

| | Mailing addresses |
|---|---|
| $1^{st}$ segment | 2nF + (4f − 3) and 2nF + (4f − 1) |
| $2^{nd}$ segment | 2nF + (4(f − F/2) − 2) and 2nF + (4(f − F/2)). |

Figure 6:
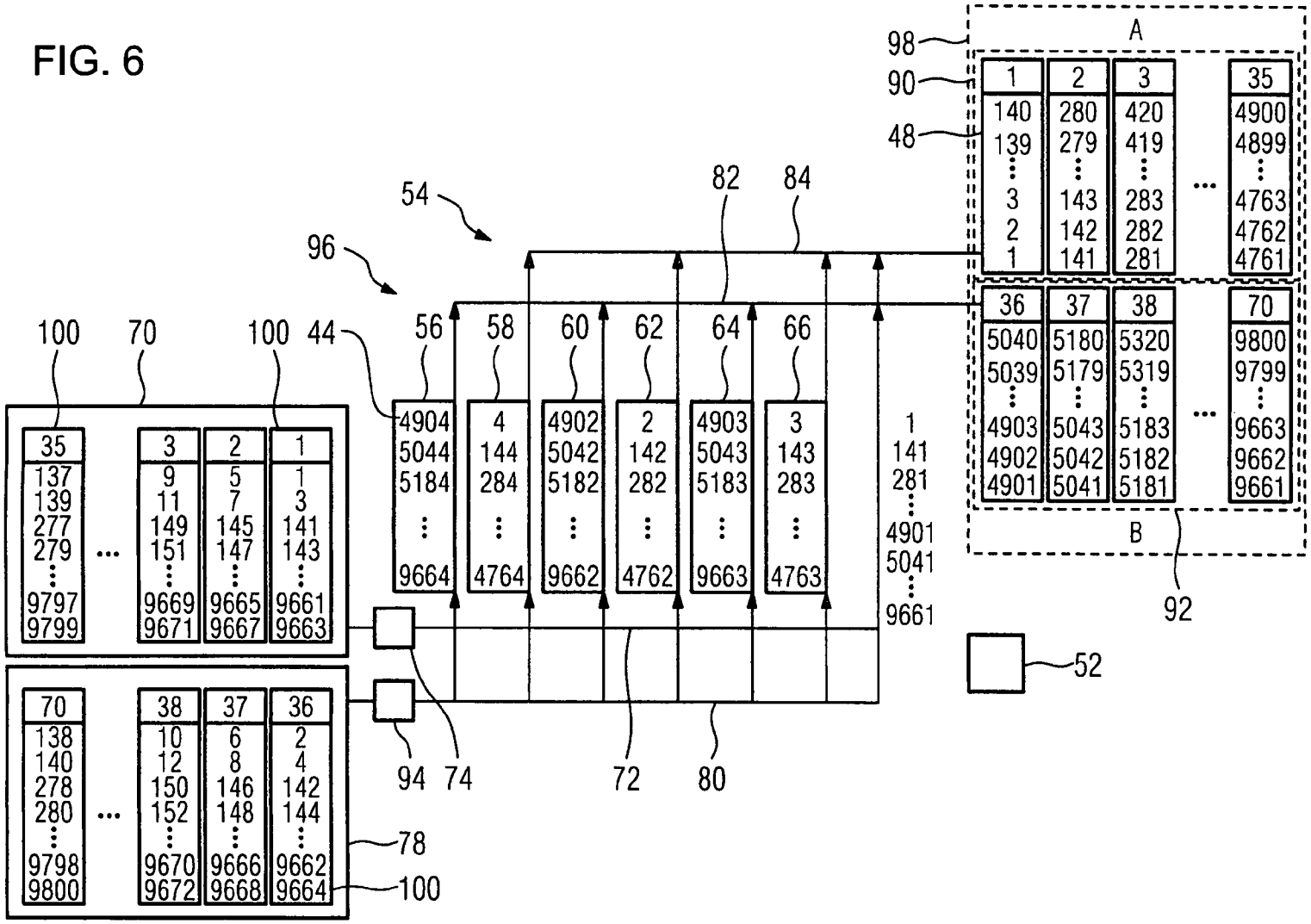
FIG. 6 is a top-plan view of the apparatus of FIG. 5 during a second sorting pass.

The sorting operation of the second sorting pass is shown in FIG. 6. The mail items 44 of the 35 compartments 48 of the first segment 90 are transferred as 35 sections 100 into the separating device 70 and the mail items 44 of the 35 compartments 48 of the second segment 92 are transferred as 35 sections 100 into the separating device 72, e.g. manually. Sorting now takes place in the presorting facility 54 in a different sorting mode from the sorting mode in the first sorting pass.

In a first sorting step, the mail items 44 of the first compartments 48 of both segments 90, 92, in other words the compartments No. 1 and 36, are separated in a parallel manner and conveyed to the six storage modules 56-66 and the bypass 68, sorted as follows:

| Compartments No. 1 and 36: | Mailing addresses |
|---|---|
| $1^{st}$ storage module 56 | 2nF + 4, where F/2 ≤ n ≤ F − 1 |
| $2^{nd}$ storage module 58 | 2nF + 4, where 0 ≤ n ≤ F/2 − 1 |
| $3^{rd}$ storage module 60 | 2nF + 2, where F/2 ≤ n ≤ F − 1 |
| $4^{th}$ storage module 62 | 2nF + 2, where 0 ≤ n ≤ F/2 − 1 |
| $5^{th}$ storage module 64 | 2nF + 3, where F/2 ≤ n ≤ F − 1 |
| $6^{th}$ storage module 66 | 2nF + 3, where 0 ≤ n ≤ F/2 − 1 |
| Bypass 68 | 2nF + 1, where 0 ≤ n ≤ F − 1. |

The numbers 1-4 can be generalized as a function M of the storage modules 56-66 used as 1≤m≤M/2. It is possible for a bypass 68 to be calculated as two storage modules 56-66.

After the mail items 44 in compartments No. 1 and No. 36 have been separated, the separating operation is stopped and the storage modules 56-66 are emptied in pairs sequentially into the sorting facility 88, starting with the storage modules 60, 62, then the storage modules 64, 66, and finally the storage modules 56, 58.

In a second sorting step, the next two sections 100 with the contents of the compartments No. 2 and No. 37 are separated and sorted into the storage modules 56-66 and the bypass 68 with the following assignments:

| Compartments No. 2 and 37 | Mailing addresses |
|---|---|
| $1^{st}$ storage module 56 | 2nF + 8, where F/2 ≤ n ≤ F − 1 |
| $2^{nd}$ storage module 58 | 2nF + 8, where 0 ≤ n ≤ F/2 − 1 |
| $3^{rd}$ storage module 60 | 2nF + 6, where F/2 ≤ n ≤ F − 1 |
| $4^{th}$ storage module 62 | 2nF + 6, where 0 ≤ n ≤ F/2 − 1 |
| $5^{th}$ storage module 64 | 2nF + 7, where F/2 ≤ n ≤ F − 1 |
| $6^{th}$ storage module 66 | 2nF + 7, where 0 ≤ n ≤ F/2 − 1 |
| Bypass 68 | 2nF + 5, where 0 ≤ n ≤ F − 1. |

The mail items 44 are then fed back to the compartments 48, before the third sorting step starts with the contents of compartments No. 3 and No. 38, etc. When all 35 or F/2 sorting steps have been executed, the mail items 44 are present in the desired sequence and sorting into delivery point sequencing is completed.

Figure 7:
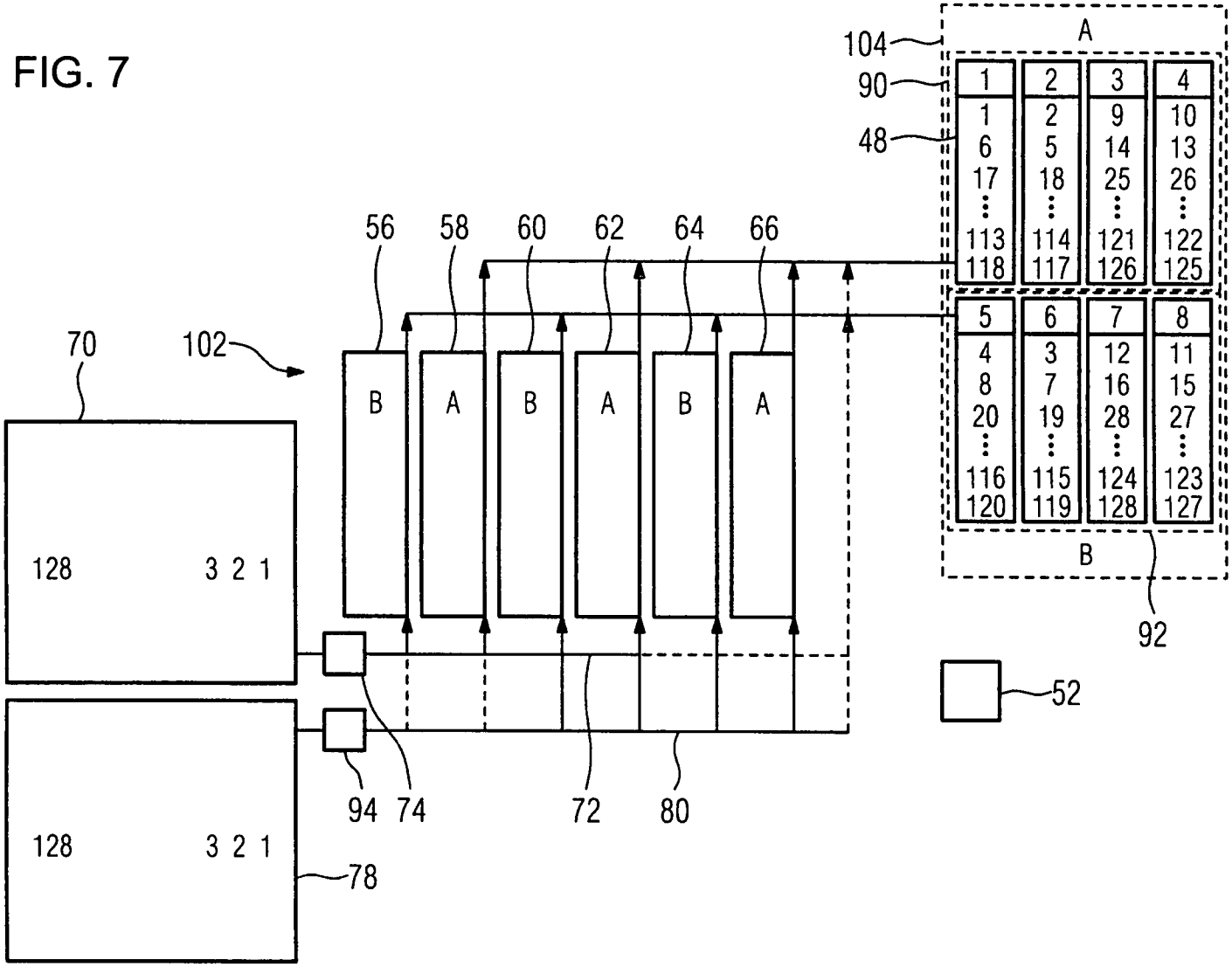
FIG. 7 is a top-plan view of a further apparatus for sorting flat mail items with large storage modules during a first sorting pass of an operation to sort into delivery point sequencing.
Figure 8:
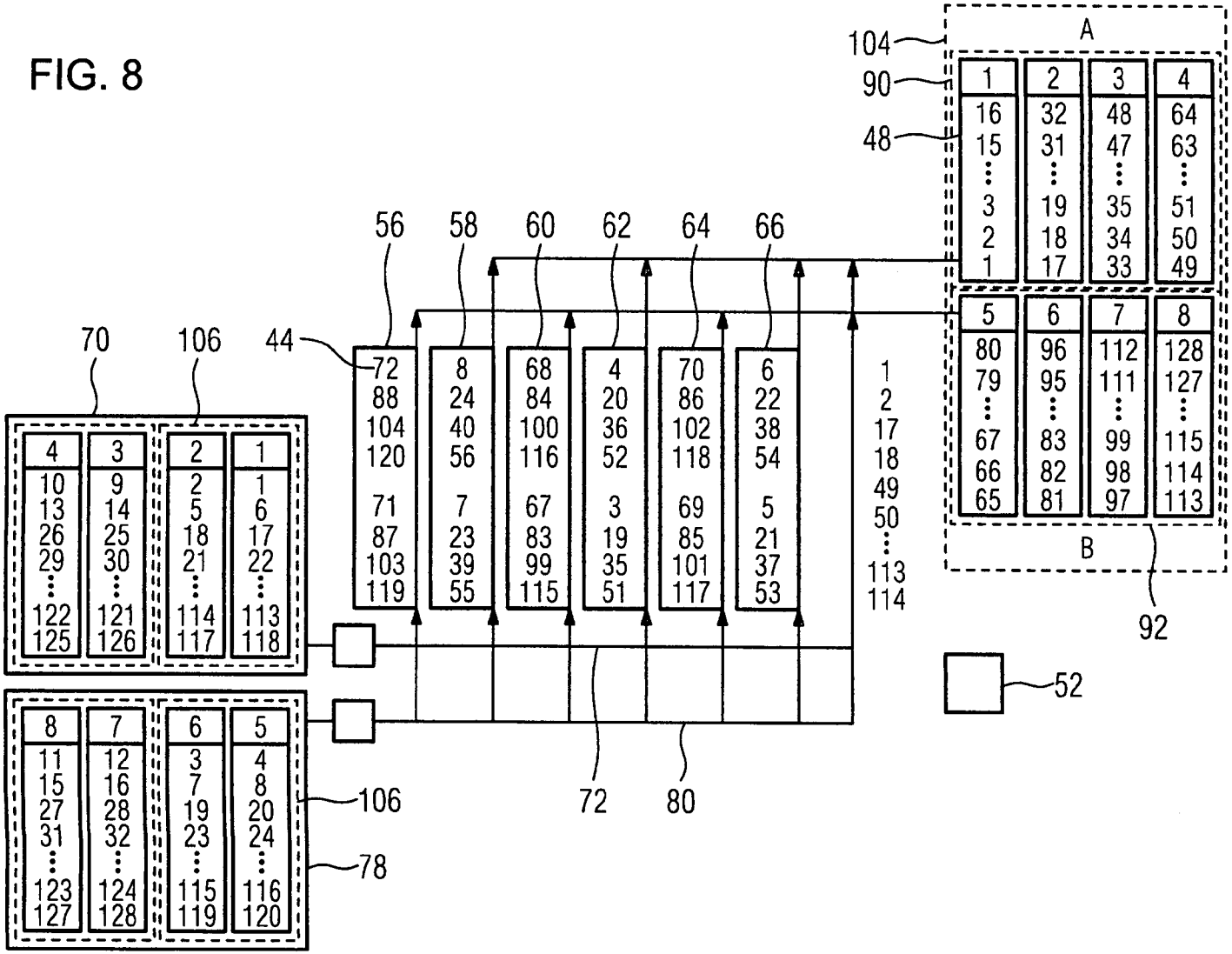
FIG. 8 is a top-plan view of the apparatus of FIG. 7 during a second sorting pass.

A number of sections 100 can also be processed in a sorting step, depending on the storage capacity of the storage modules 56-66. One example of this is given in FIGS. 7 and 8. As in FIG. 5, mail items 44 from an address space with, for example, 128 mailing addresses are sorted to the compartments 48 of the two segments 90, 92, as shown in FIG. 7.

In the second sorting pass, the compartment contents are transferred to the separating devices 70, 78, as described. In the first sorting step two compartment contents are assigned in each instance to a section 106 and sorted to the storage modules 56-66. The two compartment contents per storage module 56-66 in each instance are disposed at the front and back of the respective storage module 56-66. The storage modules 56-66 are then emptied in pairs sequentially into a sorting facility 104, starting with the storage modules 60, 62, then the storage modules 64, 66, and finally the storage modules 56, 58.

In the second sorting step, the second two sections 106 are first presorted in the storage modules 56-66 and the bypass 68 and then sorted into the compartments 48. In this example, the desired sequence of the mail items 44 is already present after the two sorting steps and sorting into delivery point sequencing is completed.

The invention claimed is:

1. A method for sorting flat mail items into delivery point sequencing, the method comprising the following steps:

sorting the flat mail items in at least a first sorting pass and a second sorting pass and carrying out sorting in a first sorting mode in the first sorting pass and in a second sorting mode, different from the first sorting mode, in the second sorting pass;

in the first sorting pass:

presorting the mail items into a number M of storage modules in a presorting facility;

sorting the mail items into sequence and depositing the mail items in a sorting facility with a number F of compartments;

setting the number F of compartments of the sorting facility to be greater by at least a factor of 2 than the number M of the storage modules;

configuring the storage modules differently than the compartments by providing the storage modules with an internal withdrawal apparatus;

between the first and second sorting passes:

removing the mail items from the compartments and feeding the mail items as a stack to at least one separating device and forwarding the mail items to the presorting facility;

in the second sorting pass:

sorting the mail items into the storage modules in the presorting facility and thereby differentiating the sorting in the second sorting pass from the presorting in the first sorting pass;

sorting the mail items into sequence and depositing the mail items in the compartments of the sorting facility; and removing the mail items from the compartments.

2. The method according to claim 1, which further comprises:

stacking a bottom mail item for at least some of the F compartments in the storage module to be emptied first in the sequence;

stacking at least one mail item above the bottom mail item for at least some of the F compartments in the next storage module to be emptied; and stacking at least one respective higher mail item for at least some of the F compartments in the storage modules to be emptied later.

3. The method according to claim 1, which further comprises conveying the mail items by way of $M_1 \geq 1$ parallel mail item feeds to the storage modules and from there in $M_2 \geq 2$ parallel mail item collectors to a respective segment of the sorting facility.

4. The method according to claim 3, which further comprises combining the storage modules into $M_3 \geq 2$ groups connected in parallel, and inserting mail items from one flow of mail items into storage modules of at least one group and at the same time removing mail items from storage modules of at least one group.

5. The method according to claim 1, which further comprises presorting the mail items from the presorting facility in the first sorting pass to $M_2 \geq 2$ parallel mail item collectors for one respective segment of the sorting facility.

6. The method according to claim 1, which further comprises depositing the mail items in the storage modules in the second sorting pass in such a manner that their sequential emptying produces sorting into sequence.

7. The method according to claim 1, which further comprises presorting with a bypass of the presorting facility circumventing the storage modules.

8. The method according to claim 1, which further comprises forming a compartment content from mail items having been deposited in a compartment in a sorting pass, and storing a number of compartment contents in the same m storage modules in a following sorting pass, where M is a number of the storage modules and m<M.

9. The method according to claim 8, wherein m=4.

10. The method according to claim 8, which further comprises providing the sorting facility with at least two segments each having a plurality of compartments, and storing all the compartment contents of at least one segment in the same m<M storage modules in the following sorting pass.

11. The method according to claim 8, which further comprises inserting as many mail items as are in two storage modules into a bypass of the presorting facility circumventing the storage modules.

12. The method according to claim 1, which further comprises feeding mail items to a separating device and from there section by section to the storage modules, and emptying the storage modules into the sorting apparatus after each section.

13. The method according to claim 12, which further comprises forming a compartment content from mail items having been deposited in a compartment in one sorting pass, and forming a section of f>1 compartment contents.

14. The method according to claim 13, which further comprises conveying the mail items by way of $M_1 \geq 1$ parallel mail item feeds to the storage modules, and $f = n \times M_1$, where n is a whole number.

15. An apparatus for sorting flat mail items into delivery point sequencing, the apparatus comprising: a sorting facility with a number F of compartments for depositing mail items sorted into sequence; a processing device for controlling sorting into delivery point sequencing; a presorting facility disposed upstream of said sorting facility in a transportation direction of the mail items; said presorting facility having a number M of storage modules disposed in parallel; said number F of compartments of said sorting facility being greater by at least a factor of 2 than said number M of said storage modules; said storage modules differing from said compartments in that said storage modules have an internal withdrawal apparatus for respective parallel accommodation of a multiplicity of mail items; and a separating device configured to receive the mail items from said compartments in the form of a stack and to return the mail items to said presorting facility for renewed sorting into said storage modules in a second sorting pass; wherein said processing device is configured to effect sorting of the flat mail items in the second sorting pass different from a first sorting pass, and thereby, in the second sorting pass: sorting the mail items into said storage modules in said presorting facility and thereby differentiating the sorting in the second sorting pass from a presorting in the first sorting pass; sorting the mail items into sequence and depositing the mail items in said compartments of the sorting facility; and removing the mail items from the compartments.

* * * * *